United States Patent [19]

Bruml

[11] 4,046,251

[45] Sept. 6, 1977

[54] DISPLAY PACKAGE

[76] Inventor: Norman A. Bruml, 24 Donnybrook Road, Montvale, N.J. 07645

[21] Appl. No.: 648,043

[22] Filed: Jan. 9, 1976

[51] Int. Cl.[2] ..... B65D 5/50

[52] U.S. Cl. ..... 206/45.14; 206/485; 206/476; 206/806; 206/463

[58] Field of Search ..... 206/485, 476, 806, 462, 206/463, 45.14, 45.19

[56] References Cited

U.S. PATENT DOCUMENTS

| | | | |
|---|---|---|---|
| 1,569,679 | 1/1926 | Sanborn | 206/485 |
| 2,405,780 | 8/1946 | Feeney et al. | 206/476 |

FOREIGN PATENT DOCUMENTS

| | | | |
|---|---|---|---|
| 1,336,171 | 7/1963 | France | 206/485 |
| 371,678 | 10/1963 | Switzerland | 206/485 |

*Primary Examiner*—William Price
*Assistant Examiner*—Douglas B. Farrow
*Attorney, Agent, or Firm*—Mel K. Silverman; David A. Jackson

[57] ABSTRACT

A display package for a longitudinally extended product such as a flashlight and the like, comprising a rectangular base possessing an opening therein, said opening conforming in outline to the longitudinal configuration of said product, a collar integral with said base which completely surrounds at least a portion of the lateral perimeter of said product, and an anchor member integral with said base and located at one or more ends of said opening to secure said product in position within said package. The invention includes a package blank of unitary construction which may be assembled to form said package containing said product in a specially configured die, as well as a particular die useful therewith. The package of the present invention is inexpensively manufactured and is of durable construction.

12 Claims, 5 Drawing Figures

52
53
62
17
19
18
59
58
55
11
25
54
63
64
28
27
26
51
47
50
51
51
48
49
51

DISPLAY PACKAGE

BACKGROUND OF THE INVENTION

The present invention relates to a display package for longitudinally extended articles, and particularly to a display package capable of suspension from a limb or arm of a display rack. The present invention is particularly useful for the packaging of products having a cylindrical body portion, such as flashlights, batteries, and the like.

In the past, display packages of the type dealt with herein generally comprised planar structures to which the products were usually fastened, either by wires and the like, or by the enclosure of the entire mounted unit in a clear, plastic heat-sealed cover sheet. These types of construction, though requiring only a single-ply backing sheet, were costly to manufacture, as the operations of affixing the product to the package involved a series of manipulative steps and related machinery which was both time-consuming to operate and costly to maintain. The resulting packages were found to be too expensive in relation to the cost of the products thus packaged and other packaging techniques were explored.

One such technique, utilizing what is referred to as the shadow-box construction, provides a substantially rectangular, three dimensional container, one side of which is usually indented to provide upper and lower supports for a thus visible product. Though widely employed, this type of construction involves the preparation of a blank employing a large portion of packaging material in relation to the product. Likewise, the assembly of the blank into the finished package usually involves several manipulative steps, often including the adhesion of a portion of the blank to itself in a separate operation.

From the above, it can be seen that the packaging known to date requires either a complex configuration involving a plurality of sequential operations, and/or a significant expenditure in packaging materials. Particularly respecting the latter, it is well known that the cost of plastic film such as that employed in packaging has risen sharply, and useful alternatives to such materials are being sought.

SUMMARY OF THE INVENTION

In accordance with the present invention, a display package for longitudinally extended products is prepared which comprises a rectangular planar base possessing an opening therein conforming in outline to the longitudinal configuration of the product, a collar integral with said base which completely surrounds at least a portion of the cylindrical perimeter of said product, and an anchor member integral with said base and located at one or more ends of said opening to secure said product in position within said package.

The invention further comprises a uniquely shaped blank suited for assembly into the package of the present invention in one continuous operation. The method of assembly useful herein comprises the placement of the blank into the lower portion or platen of a die configured to correspond with the product, followed by the placement therein of the product and the overlapping portion or flap of said blank thereof, whereby the respective flaps of said blank are in alignment with each other. The upper portion or platen of said die is then brought into engagement with said lower portion while said folded blank is held in fixed position therein by cooperating spring-loaded ball detents located in the side surface of said lower portion, and the blank is shaped and sealed to form the final package.

The package of the present invention possesses numerous advantages, among them simplicity of design and assembly. The materials required to prepare this package may be selected from inexpensive and plentiful sources such as cardboard and the like. The design, by its nature, requires a minimum quantity of packaging materials to be employed, while conferring a strength and integrity of the final package which resists shipping or tampering during display in the market place.

Accordingly, it is a principal object of the present invention to provide a display package of the planar type useful for products of longitudinally extended shape which may be quickly and inexpensively manufactured.

It is a further object of the present invention to provide a display package as aforesaid which is prepared from a blank providing a simple aesthetic design.

It is yet a further object of the present invention to provide a display package as aforesaid which may be manufactured by a procedure comprising a reduced number of assembly steps.

It is a still further object of the present invention to provide an apparatus for the expeditious assembly of the display package of the present invention which is capable of high speed automated operation.

Further objects and advantages will become apparent from a consideration of the description which follows with reference to the accompanying drawings.

BRIEF DESCRIPTION OF THE DRAWINGS

In the drawings wherein like reference characters denote like parts in the several views.

DETAILED DESCRIPTION

In accordance with the present invention, the foregoing objects and advantages are readily obtained.

Figure 1:
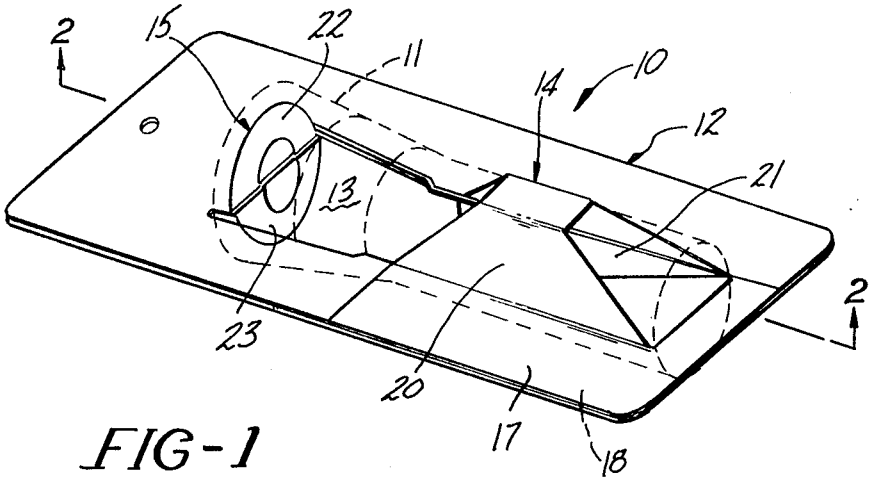
FIG. 1 is a perspective view of the display package of the present invention.

The display package of the present invention comprises a substantially planar structure possessing a central cavity fitted with a surrounding collar to hold the product therein. Referring to FIG. 1, the display package 10 of the present is shown in perspective as finally assembled and containing a product, herein illustrated in phantom as a flashlight 11, though it is to be understood that the invention is broadly applicable to all longitudinally extended articles of commerce. Package 10 comprises a generally rectangular planar base 12 possessing an opening 13 therein conforming in outline to the shape of flashlight 11. Collar 14 is provided which is integral with base 12 and serves to maintain flashlight 11 in fixed position within opening 13. In addition to collar 14, base 12 is provided with at least one anchor member 15, also integral with base 12, which in the present illustration communicates with visor 16, in a manner better illustrated in FIG. 2, to prevent flashlight 11 from slipping out of opening 13. Though only one anchor member is illustrated herein, the invention is not limited thereto, as products exist which would be advantageously retained by anchor members on both longitudinal ends. Also, the anchor members could be modified to grasp said longitudinal ends positively.

Figure 2:
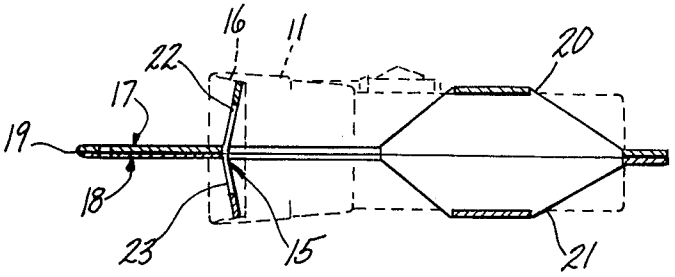
FIG. 2 is a longitudinal section taken from line 2—2 in FIG. 1.

Referring now to FIGS. 1 and 2, package 10 can be observed in greater detail to be a two-ply structure comprised to a pair of identical complementary flaps. In FIG. 2, comprising a longitudinal sectional view taken through line 2—2 of FIG. 1, flaps 17 and 18 are integral with each other at fold line 19, and, in the assembled state, are in full alignment. Both flaps possess the identical structural features, including the provision of opening 13. Further, flaps 17 and 18 are provided with respective harness members 20 and 21, which together comprise collar 14. Harness members 20 and 21 are integral with respective flaps 17 and 18 in a manner discussed in detail later on.

In addition to harness members 20 and 21, flaps 17 and 18 possess tabs 22 and 23 which project longitudinally from a laterally directed edge of the opening 13 defined in both flaps. Tabs 22 and 23, as illustrated in FIGS. 1 and 2, have been bent at fold lines provided thereon so as to project away from each other at acute angles with respect to the plane of base 12, to communicate with visor 16 of flashlight 11.

Figure 3:
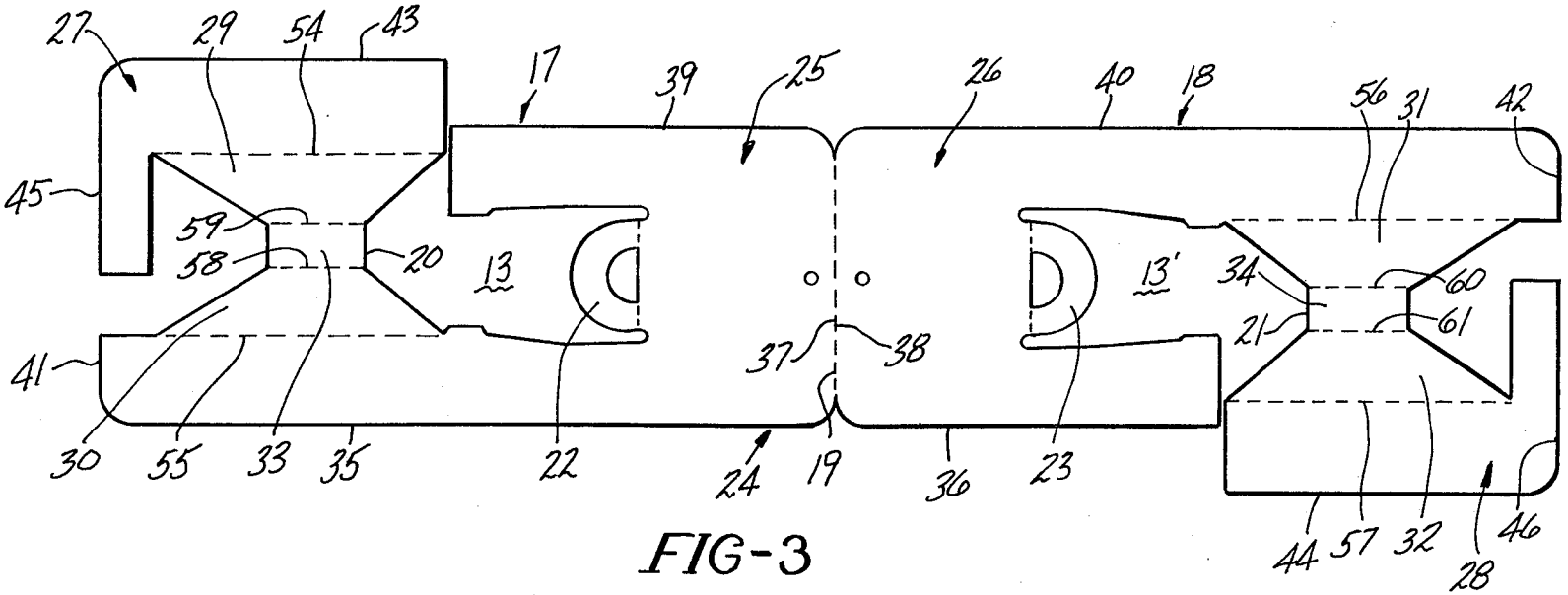
FIG. 3 is a plan view showing the display package blank prepared in accordance with the present invention.

Referring now to FIG. 3, comprising a plan view, the planar package blank 24 of the present invention is shown in full detail. Blank 24, as noted earlier, comprises flaps 17 and 18, which can be seen herein to be integral with each other at fold line 19, and in reversed end-to-end abuttment. Flaps 17 and 18 possess openings 13 and 13', said openings adapted for registration and alignment with each other in the manner illustrated in FIGS. 1 and 2. Flaps 17 and 18 are comprised of major flap portions 25 and 26, and minor flap portions 27 and 28, respectively. Minor flap portions 27 and 28 are diagonally opposed and oppositely directed with respect to each other and laterally displaced with respect to major flap portions 25 and 26, and are maintained in integral connection therewith by harness members 20 and 21, discussed earlier. Harness members 20 and 21 comprise a pair of trapezoidal supports labeled 29 and 30 on harness member 20, and 31 and 32 on harness member 21. These supports are connected integrally by bridge portions 33 and 34.

As noted earlier with respect to FIGS. 1 and 2, flaps 17 and 18 are provided with respective tabs 22 and 23, which, in FIG. 3, extend into openings 13 and 13', respectively. Tabs 22 and 23 cooperate in the assembled package to define anchor member 15.

In the illustration of FIG. 3, both major flap portions 25 and 26, and minor flap portions 27 and 28, are of a generally L-shaped configuration. In this instance, minor flap portions 27 and 28 are in diagonal opposition to said major flap portions 25 and 26, respectively, as well as to each other. By comparison, the blank of the present invention also includes minor flap portions comprising laterally displaced, generally rectangular segments, such as those depicted in FIG. 5, to be discussed later on, and the present invention should not be construed as limited to a particular shape of said minor flap portions.

Referring again to FIG. 3, it can be seen that each of the respective flap portions are dimensioned in proportion to each other to enable the finally assembled package to assume its rectangular configuration. Thus, major flap portions 25 and 26 possess greater longitudinal dimensions 35 and 36, and greater lateral dimensions 37 and 38, which respectively correspond to the longitudinal and lateral dimensions of the assembled package. Flap portions 25 and 26 also possess lesser longitudinal dimensions 39 and 40, and lesser lateral dimensions 41 and 42 of such size that, when taken in sum adjacent corresponding greater longitudinal dimensions 43 and 44, and greater lateral dimensions 45 and 46, of respective minor flap portions 27 and 28, said sums equal the respective greater dimensions of said major flap portions 25 and 26. The foregoing is readily apparent from, and particularly pertinent to a consideration of FIGS. 1 and 3 together. The above relationship is particularly pertinent to the configuration of FIG. 3, and is not proposed as a limitation on the scope of the invention.

Figure 4:
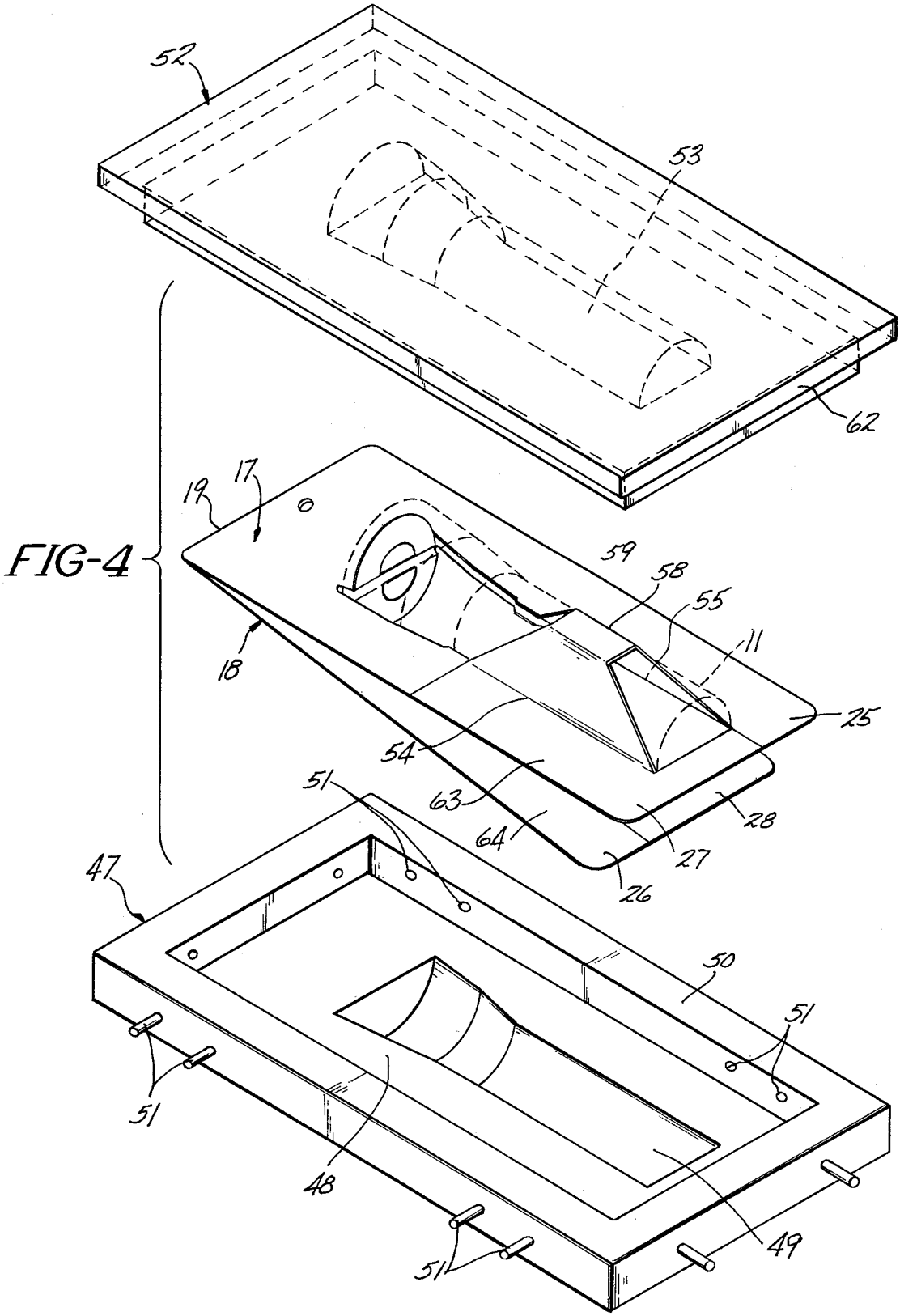
FIG. 4 is an exploded view in perspective showing the folded blank of the present invention prior to the sealing of the product therein and a schematic representation of a sealing apparatus useful therefor.

Referring now to FIG. 4, the method of the present invention comprises the provision of above-described blank 24 in folded position along line 19 whereby flaps 17 and 18 approach an overlapping relation to each other. Though FIG. 4 depicts members 27 and 28 in direct contact adjacent members 25 and 26, it should be understood that such does not take place until after the closing of the die.

The next step comprises the placement of the folded blank within the corresponding cavity 48 provided within lower platen 47 of the die assembly or apparatus. Lower platen 47 is provided with an indentation 49 corresponding to the shape of flashlight 11 to permit the application of sealing heat and pressure to the surfaces of flaps 17 and 18 without damaging the product.

In the next step, the flashlight 11 is placed between flaps 17 and 18, and referring to FIGS. 1, 3 and 4, harness members 20 and 21 are bent at score lines 54, 55, 56 and 57, respectively, and at respective fold lines 58, 59, 60 and 61, to assume their final configuration, and to join to form collar 14. At the same time flap portions 27 and 28 migrate toward portions 25 and 26, respectively, and meet at what appears afterwards to be parting lines therebetween. This operation may be conducted manually or automatically by appropriate machinery, not shown. The thus folded blank 24, resembling package 10 in FIG. 1, is then secured in position within lower platen 47 by a plurality of spring-loaded ball detents 51 provided on surrounding frame 50, which restrain the outer edges of flaps 17 and 18 and prevent them from separating from each other. The number and arrangement of detents 51 is not critical, and can comprise as few as one on each of three sides of frame 50.

While the blank is being held in this position, upper platen 52 of the die assembly is brought into engagement with lower platen 47, whereby appropriately configured die face 53, shown substantially in phantom, nests within frame 50. Upper platen 52 is seen to possess an overhanging base structure 62, which is of a major surface area larger than that of die face 53. Base structure 62 enables upper platen 52 to rest upon the upper edge of frame 50 so that die face 53 is held in fixed, spaced relationship to cavity 48 bearing folded blank 24. Though the illustration of FIG. 4 depicts die face 53 as solid, it is contemplated that die face 53 may possess cavities other than that corresponding to the shape of folded blank 24, whereby only those raised portions in contact with blank 24 will transmit sealing heat thereto.

The sealing operation comprises the transmission of the effective amount of heat energy from a heating means, not shown, through die face 53 to blank 24 while the latter is under compression, to facilitate the permanent bonding thereof to form package 10. Suitable heat sealable substrate has been previously applied to mating surfaces 63 and 64 of flaps 17 and 18, respectively, to ensure a permanent seal.

Figure 5:
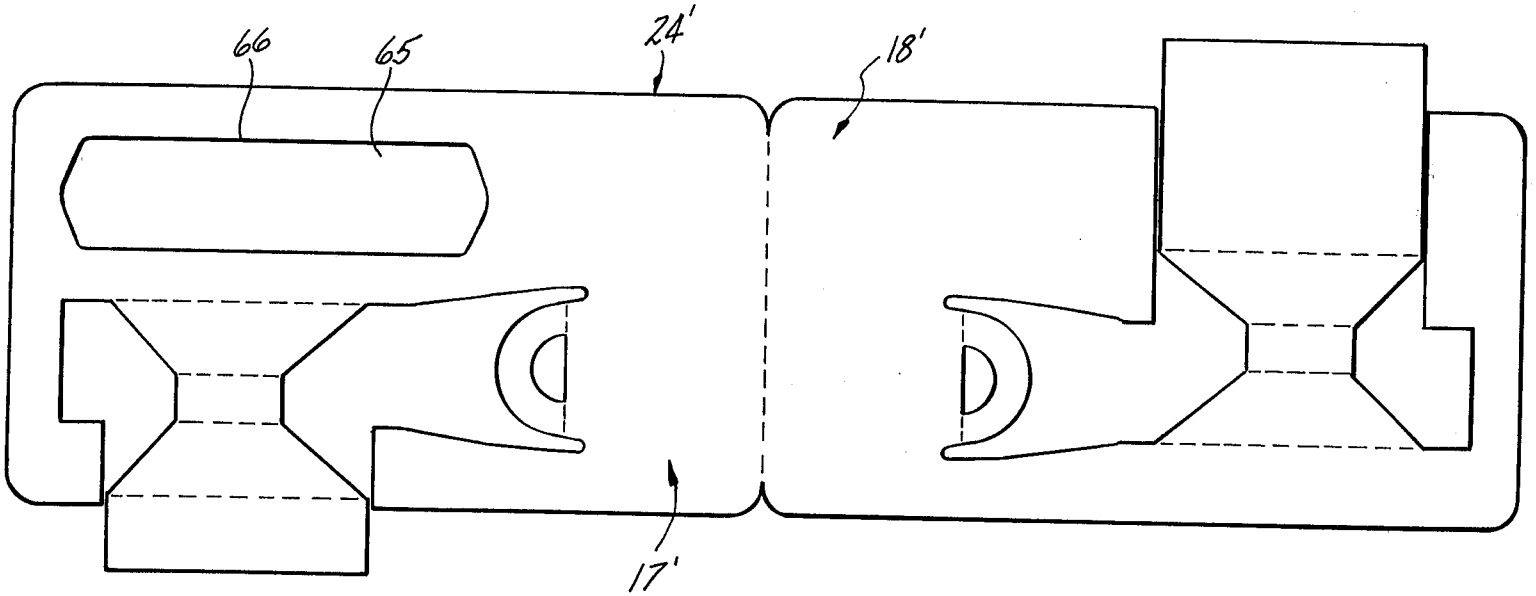
FIG. 5 is a plan view showing a package blank representing an alternate embodiment of the invention.

A wide variety of package configurations are possible within the scope of the present invention. Referring to FIG. 5, a blank 24' is shown which is laterally widened to provide space for the mounting of a 'blister-pack' of batteries. As the 'blister-pack' requires only a mounting base upon which to rest, one of the flaps comprising blank 24' is provided with a substantially rectangular opening 65 through which the batteries may protrude. In this type of package, the batteries would first be sandwiched or otherwise encased in a clear plastic material, which would extend into framing engagement with the perimeter 66 of opening 65. Thus, upon the sealing together of respective flaps 17' and 18', said plastic material would be fixedly sandwiched between said flaps to retain the batteries in position. Naturally, the shape of opening 65 may vary to accomodate the display of products possessing a wide variety of configurations, and the invention should not be limited to the illustrations presented herein.

Referring further to FIG. 5, blank 24' is in all other respects similar to blank 24 of FIG. 3, as flaps 17' and 18' are in reversed end-to-end abuttment, and, respectively, comprise major and minor flap portions connected by harness members.

Though the foregoing description and drawings have proceeded with reference to a flashlight, it is understood that other products of similar configuration are encompassed herein.

It is to be understood that the invention is not limited to the illustrations described and shown herein, which are deemed to be merely illustrative of the best modes of carrying out the invention, and which are suitable of modification of form, size, arrangement of parts and details of operation. The invention rather is intended to encompass all such modifications which are within its spirit and scope as defined by the claims.

What is claimed is:

1. A display package for a longitudinally extended product comprising a rectangular, planar base possessing a central opening therein, said base comprising a pair of substantially rectangular flaps of identical size and shape in overlapping relation to each other, said central opening conforming in outline to the longitudinal configuration of said product, a collar integral with said base which completely surrounds a major portion of the lateral perimeter of said product, said collar comprising opposed harness member respectively integral with corresponding flaps at said opening, said harness members comprising, respectively, paired, opposed trapezoidal supports extending from said flap and in contact therewith along the major portion of the lateral perimeter of said central opening, and rectangular bridge portions linking said trapezoidal supports at the apical ends thereof, and an anchor member integral with said base and located at one or more ends of said opening to secure said product in position within said package.

2. The package of claim 1 wherein said base is comprised of a pair of substantially rectangular flaps of identical size and shape arranged in overlapping relation with respect to each other.

3. The package of claim 2 wherein said collar is comprised of opposed harness members, each of said harness members integral with a corresponding rectangular flap.

4. The package of claim 3 wherein said harness members comprises a pair of trapezoidal supports extending from said flap, and joined by a rectangular bridge portion.

5. The package of claim 1 wherein said anchor member comprises a pair of cooperating tabs, each tab integral with a corresponding flap and adapted for communication with a lateral surface of said product, said tabs projecting away from each other at acute angles with respect to the plane of said base.

6. The package of claim 5 wherein said tabs, taken together, define a perimeter corresponding in shape to the lateral cross section of said product.

7. The package of claim 1 further comprising an opening located adjacent a lateral edge of said base and midway of its dimension, to facilitate the mounting of said package for display.

8. A blank designed for the preparation of a display package for a longitudinally extended product which comprises:

A pair of substantially rectangular flaps integral with each other at a point of reversed end-to-end abuttment and adapted for placement in overlapping association, each of said flaps possessing at least one opening therein, said openings adapted for registration and alignment with each other, wherein each of said flaps comprises a major flap portion and a minor flap portion, said minor flap portion is diagonally opposed to the corresponding minor flap portion located on the corresponding overlapping flap and extends in a laterally opposite direction thereto, and wherein said minor flap portion is laterally displaced with respect to said major flap portion and is maintained in integral connection therewith by a harness member integral therewith and extending therebetween.

9. The blank of claim 8 further comprising at least two tabs integral with lateral ends of the opening of the respective flaps, and longitudinally extended in opposite directions from each other, wherein upon assembly of said package, said tabs are aligned and bent in opposite directions to form an anchor member for communication with a lateral surface of said product.

10. The blank of claim 8 wherein all of said flap portions are generally L-shaped and each possess a longitudinal dimension and a lateral dimension, said major flap portion possessing a greater lateral dimension and a greater longitudinal dimension, corresponding to the respective lateral and longitudinal dimensions of the assembled package, and a lesser lateral dimension and a lesser longitudinal dimension, said lesser dimensions sized such that the individual sums of said lesser dimensions and the corresponding respective greater dimensions of said minor flap portion member equal the respective greater dimensions of said major flap portion.

11. The blank of claim 8 further including an additional opening in one of said flaps adapted to receive and support a transparent mounting of a further product.

12. The blank of claim 8 wherein said harness member comprises a pair of trapezoidal supports extended into juxtaposition from corresponding longitudinal edges of said flap portions and joined by a rectangular bridge portion.

* * * * *